US011437740B2

(12) United States Patent
Stolze

(10) Patent No.: US 11,437,740 B2
(45) Date of Patent: Sep. 6, 2022

(54) CONTACT INSERT, ASSEMBLY PRODUCED THEREWITH, AND METHOD FOR PROVIDING THE CONTACT INSERT

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/219,208

(22) Filed: Mar. 31, 2021

(65) Prior Publication Data

US 2021/0218160 A1 Jul. 15, 2021

Related U.S. Application Data

(63) Continuation of application No. PCT/EP2019/076094, filed on Sep. 26, 2019.

(30) Foreign Application Priority Data

Oct. 5, 2018 (DE) ..... 10 2018 124 622.6

(51) Int. Cl.
*H01R 4/48* (2006.01)

(52) U.S. Cl.
CPC ..... *H01R 4/4836* (2013.01)

(58) Field of Classification Search
None
See application file for complete search history.

(56) References Cited

U.S. PATENT DOCUMENTS

| | | | | |
|---|---|---|---|---|
| 7,507,107 | B2 | 3/2009 | Tuerschmann et al. | |
| 9,276,331 | B2 | 3/2016 | Stadler et al. | |
| 10,193,244 | B2 * | 1/2019 | Aboulkassem | H01R 4/4845 |
| 10,910,737 | B2 * | 2/2021 | Wu | H01R 9/2483 |
| 2018/0212342 | A1 * | 7/2018 | Koellmann | H01R 13/115 |

FOREIGN PATENT DOCUMENTS

| | | | |
|---|---|---|---|
| DE | 8800750 | U1 | 3/1988 |
| DE | 20205821 | U1 | 8/2003 |
| DE | 102007031194 | A1 | 1/2009 |
| DE | 102014200271 | A1 | 7/2015 |
| EP | 3282518 | A1 | 2/2018 |

OTHER PUBLICATIONS

International Search Report dated Dec. 9, 2019 in corresponding application PCT/EP2019/076094.

* cited by examiner

*Primary Examiner* — Ross N Gushi

(74) *Attorney, Agent, or Firm* — Muncy, Geissler, Olds & Lowe, P.C.

(57) ABSTRACT

A contact insert for clamping an electric conductor to a clamping point by a clamping spring. The contact insert has a contact frame having at least one contact base and a respective lateral wall arranged at an angle to the contact base, wherein the lateral walls run substantially parallel to each other, and a receiving area is formed between the lateral walls. The clamping spring is arranged in the receiving area. The clamping spring has a contact arm, a spring bend, which adjoins the contact arm, and a clamping arm, which adjoins the spring bend. The contact arm is secured to one or both lateral walls or to at least one securing wall, which adjoins one or both lateral walls. The clamping arm is pretensioned relative to the contact base. The clamping point for the electric conductor to be clamped is formed between the clamping arm and the contact base.

12 Claims, 6 Drawing Sheets

CONTACT INSERT, ASSEMBLY PRODUCED THEREWITH, AND METHOD FOR PROVIDING THE CONTACT INSERT

This nonprovisional application is a continuation of International Application No. PCT/EP2019/076094, which was filed on Sep. 26, 2019 and which claims priority to German Patent Application No. 10 2018 124 622.6, which was filed in Germany on Oct. 5, 2018 and which are both herein incorporated by reference.

BACKGROUND OF THE INVENTION

Field of the Invention

The present relates to a contact insert for clamping an electric conductor to a clamping point by means of a clamping spring. The invention relates furthermore to an assembly with such a contact insert and with a busbar which has a cutout in which the contact insert is secured. The invention relates furthermore to a conductor connection terminal with such a contact insert. The invention relates furthermore to a method for providing such a contact insert.

Description of the Background Art

In general, the invention relates to the field of conductor connection technology by means of spring force clamping. A conductor connection terminal with such spring force clamping is known, for example, from EP 3 282 518 A1, which is incorporated herein by reference.

SUMMARY OF THE INVENTION

It is therefore an object of the present invention to provide a contact insert with a wide range of possible applications. Further, an assembly formed herewith with a busbar as well as a conductor connection terminal are to be provided. In addition, an advantageous method for providing such a contact insert is to be set forth.

This object is achieved by a contact insert for clamping an electric conductor to a clamping point by means of a clamping spring, wherein the contact insert has a contact frame, which has at least one contact base and a respective lateral wall arranged at an angle to the contact base, wherein the lateral walls run substantially parallel to each other, and a receiving area is formed between the lateral walls, said clamping spring being arranged in the receiving area, wherein the clamping spring has a contact arm, a spring bend, which adjoins the contact arm, and a clamping arm, which adjoins the spring bend, wherein the contact arm is secured to one or both lateral walls or to at least one securing wall, which adjoins one or both lateral walls, and the clamping arm is pretensioned relative to the contact base, said clamping point for the electric conductor to be clamped being formed between the clamping arm and the contact base.

The contact insert of the invention can be used universally, both as an independent structural unit and as part of a conductor connection terminal or of an assembly with a busbar. The contact insert can in particular be used as a modular contact insert, which can be employed as a modular subassembly in other devices, such as, e.g., the aforementioned assembly with the busbar or in the conductor connection terminal.

The clamping point for the electrical conductor to be clamped can be formed directly between the clamping arm and the contact base, or indirectly in that, for example, an additional component is arranged on the contact base, such as, e.g., a busbar of the contact insert.

The lateral walls are each arranged at an angle to the contact base. In this way, the contact frame can be designed, for example, as a metal component which is angled multiple times, e.g., as a sheet metal part, e.g., as a stamped and bent component.

The contact frame can be formed wedge-shaped in a plan view of a respective lateral wall. Because of this wedge-shaped configuration, the contact insert can be used particularly universally; in particular it can be inserted directly into a comparatively small cutout in a busbar. The clamping spring can be designed substantially V-shaped in side view. In this regard, the clamping spring can be arranged in the contact frame in such a way that the spring bend is located at the wider end of the wedge-shaped contact frame. The spring bend can be arranged entirely or partially in the area surrounded by the contact frame or entirely or partially outside this area.

The contact frame can have a plurality of bearing elements for mounting an actuation element which is designed to actuate the clamping arm, so that the actuation element can be optionally mounted on one of the plurality of bearing elements and secured to the contact frame. In this way, a highly versatile and universal connection system for the actuation element can be realized. By actuating the clamping arm, the clamping point in particular can be opened in order to remove an already clamped electrical conductor or to clamp in a simple manner an electrical conductor to the clamping point.

The actuation element can be designed as an actuation lever, e.g., as a pivotable actuation lever or as a pushbutton. The pushbutton can be designed as a linearly displaceable or pivotable pushbutton. The bearing elements can be realized, for example, as pins which are present on the contact frame and protrude inward or outward from the surface of the contact frame, or as slots in the contact frame, or as a combination of such bearing elements.

According to an example, it is provided that one, multiple, or all bearing elements are arranged on one or on both lateral walls of the contact frame. This allows a kinematically favorable securing of the actuation element on the contact frame and favorable action upon the clamping arm in order to open the clamping point.

The contact insert can have the actuation element. In this way, the functionality of the contact insert is increased. The contact insert can already be provided with the actuation element as a structural unit.

The actuation element can overlap the contact frame on both sides. For this purpose, the actuation element can have a substantially U-shaped region which has two side cheeks that run substantially parallel to one another. The actuation element can then overlap the contact frame on both sides with the side cheeks.

If the bearing elements, realized on the contact frame, for mounting the actuation element are designed as cutouts, e.g., with an at least part-circular inner contour, the actuation element can have on one or both side cheeks a bearing pin which protrudes towards the inside of the U-shaped area and can be inserted into the bearing element, formed as a cutout, of the contact frame. The cutout can be completely surrounded on the periphery by the material of the contact frame or have an opening at which the cutout is not surrounded on the periphery by the material of the contact frame.

The contact arm can have laterally protruding fixing projections which engage positively in fixing slots present in one or in both lateral walls. In this way, the contact arm can be secured very reliably and robustly to the contact frame. Additional securing of the clamping spring is then not necessary. The contact arm can have, e.g., one or more laterally protruding fixing projections on side edges pointing away from one another.

The clamping arm can have at least one laterally protruding actuating tab which protrudes into an actuating slot in at least one lateral wall or protrudes through the actuating slot, wherein the actuating tab has at least one contact surface for acting on the actuating tab by means of an actuation element, so that the clamping arm can be displaced when the actuating tab is actuated by means of the actuation element. This allows a reliable actuation of the clamping arm to open the clamping point. In addition, the actuation element can be shaped relatively simply and can, for example, consist of a plastic material.

Such an actuating tab can be located on one or on both side edges of the clamping arm, said edges pointing away from one another, i.e., protrude from the clamping arm on one or both sides. In this way, the clamping arm is wider in the area of the actuating tab than at other points, e.g., in the area of an end-side clamping edge of the clamping arm.

The contact frame can be designed as a receiving cage, which is essentially closed on the periphery, for receiving the clamping spring. In this way, the clamping spring is largely or completely surrounded by the contact frame and embedded therein. For this purpose, the contact frame can, for example, have an extension on one or both lateral walls at their ends facing away from the contact base, which extension is arranged at an angle to the respective lateral wall. The extension or extensions then largely or completely cover the contact arm side facing away from the clamping point.

The contact arm can have a securing tab that protrudes from the contact frame, wherein the contact insert can be releasably fixed to a busbar via the protruding securing tab by means of spring force fixing. This has the advantage that the contact insert can be fixed in the cutout of the busbar in a simple and quick manner and can also be released therefrom. The fixation takes place by means of the spring force of the clamping spring, which is transferred to the external busbar via the contact arm. The protruding securing tab can in particular be located at the narrow end of the wedge-shaped contact frame. The securing tab can also have a free end region of the contact arm. The securing tab can advantageously function as a bridging spring for connection to the busbar.

The invention relates furthermore to an assembly with a contact insert of the type explained above and a busbar, which has a cutout, wherein the contact insert is resiliently fixed in the cutout of the busbar by means of the securing tab. The previously described advantages can also be realized in this way.

The invention also relates to a conductor connection terminal with a contact insert of the previously described type, wherein the conductor connection terminal has an insulating-material housing which completely or predominantly surrounds the contact insert. The previously described advantages can also be realized in this way.

The invention also relates to a method for providing a contact insert of the previously described type, with the following features: producing the clamping spring with the fixing projections protruding laterally on the contact arm; providing a semi-finished product of the contact frame by punching out a piece of sheet metal from a sheet metal plate; and generating the final shape of the contact frame by a bending process in which the clamping spring is inserted into the contact frame at least before the end of the bending process and is fixed in the cutouts in the lateral walls by the positive fixation by means of the fixation projections In this way, the previously described contact insert can be advantageously fabricated and provided. As a result, the technical challenge can be solved in particular that the clamping spring has to be inserted into the contact frame and thus fixed thereto before the final bending of the contact frame.

Within the context of the present invention, the indefinite article "a" ("an") is not to be understood as a numeral. If therefore, e.g., a component is being discussed, this should be interpreted in the sense of "at least one component." Insofar as angles are given in degrees, they refer to a circular measure of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein: The invention will be described in more detail hereinbelow with the aid of exemplary embodiments with use of drawings.

FIGS. 5, 7, 10, 11, 14, and 15 each show side sectional illustrations and FIGS. 6, 8, 12, 13, 16, and 17 each show side views. FIG. 9 shows a partial perspective illustration.

DETAILED DESCRIPTION

Figure 1:
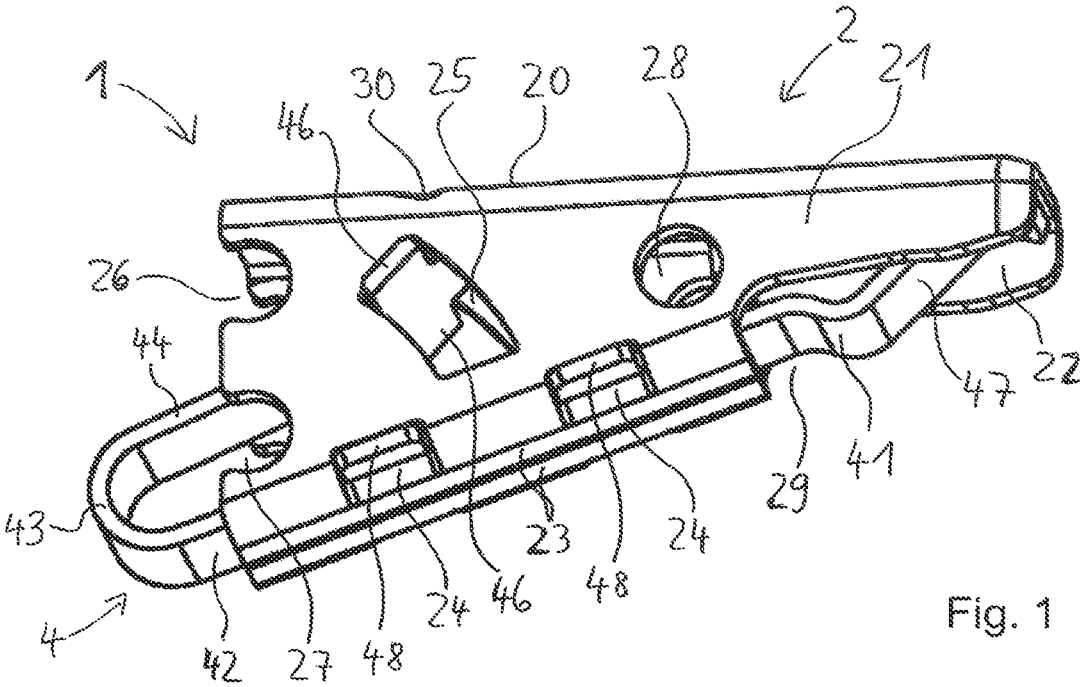
FIG. 1 shows a contact insert in a perspective illustration.
Figure 2:
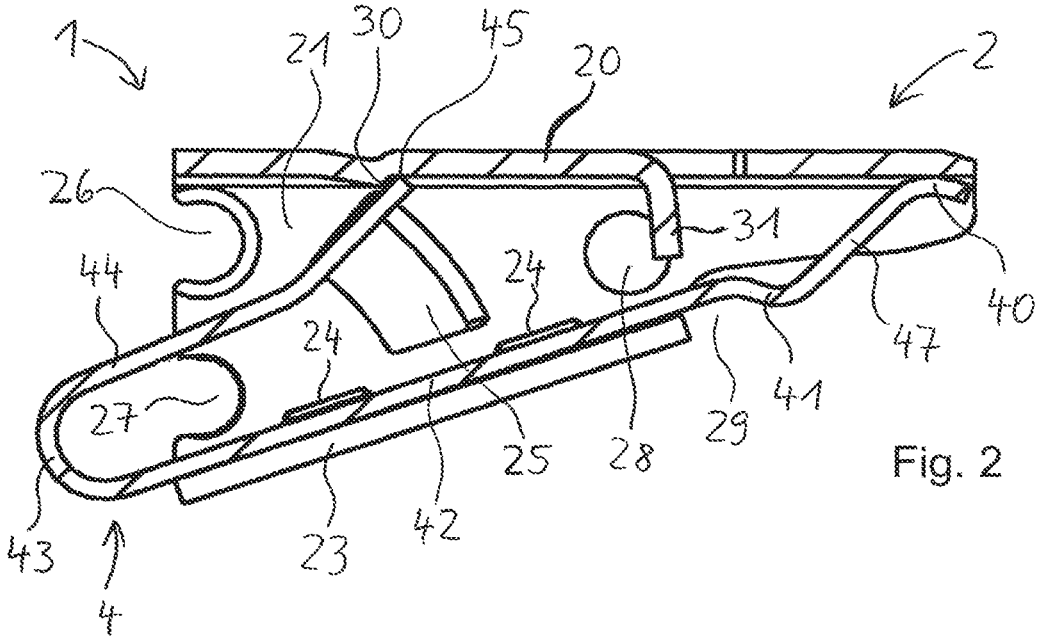
FIG. 2 shows the contact insert according to FIG. 1 in a side sectional view.

Contact insert 1 shown in FIGS. 1 and 2 has a contact frame 2 and a clamping spring 4 inserted into contact frame 2 and secured to it in a positive manner.

Contact frame 2 is designed as a box-shaped retaining cage, largely closed at the periphery, for clamping spring 4. Contact frame 2 has a contact base 20 and lateral walls 21, 22, which are arranged on the left and right side of contact base 20 and are angled with respect to contact base 20, e.g., substantially at right angles to contact base 20. At their end region remote from contact base 20, lateral walls 21, 22 each merge into an extension 23 arranged at an angle to the respective lateral wall 21, 22. In lateral walls 21, 22 in the vicinity of extensions 23, there is at least one, preferably two, arranged fixing slots 24; these are used for the positive fixing of clamping spring 4, as will be explained in more detail below. Further, there are respective actuating slot 25 in lateral walls 21, 22, which are used for actuating a clamping arm 44 of clamping spring 4.

A plurality of bearing elements 26, 27, 28, which are designed in the form of cutouts, in particular in the form of cutouts with a circular or partially circular inner circumference, are located further on lateral walls 21, 22, distributed over the surface of the lateral wall. Bearing elements 26, 27 have a partial circular shape, and a complete circular shape is realized in the case of bearing element 28. Bearing elements 26, 27, 28 form alternative options for mounting an actuation element, wherein, according to the user's choice, a suitable actuation element can be secured to one of these bearing elements or to one bearing element per lateral wall 21, 22.

Ribbing is formed in contact base 20, said ribbing which forms a contact element 30, in particular a contact edge which protrudes towards the interior space enclosed by contact frame 2.

Clamping spring 4 has a contact arm 42, a spring bend 43 adjoining contact arm 42, and a clamping arm 44 adjoining spring bend 43. Clamping arm 44 ends at its free end with a clamping edge 45. A clamping point for an electrical conductor is formed, in particular on contact element 30, between clamping edge 45 and the side of contact base 20, said side facing the interior of contact frame 2. If no electrical conductor is clamped at the clamping point, then clamping edge 45 rests against contact element 30 or at least in the vicinity of contact element 30 on contact base 20.

On contact arm 42 on the side facing away from spring bend 43, clamping spring 4 has a concavely curved area which forms a securing tab 41 for securing contact insert 1 to a busbar 9. Contact arm 42 extends beyond securing tab 41 via a ramp-like area 47 to an arc-shaped area 40 at the end. Arc-shaped area 40 at the end can in turn rest against contact base 20. Ramp-shaped area 47 forms an insertion aid for inserting contact insert 1 into a cutout in busbar 9.

Clamping spring 4 has in the area of contact arm 42 laterally on both sides at least one, preferably two protruding fixing projections 48 which engage positively in fixing slots 24 and in this way secure clamping spring 4 to contact frame 2.

Clamping spring 4 has actuating tabs 46, protruding on both sides in the area of clamping leg 44 and by means of which clamping arm 44 can be displaced either directly by manual actuation, optionally with a tool, or indirectly via an actuation element 6 of contact insert 1. Actuation tabs 46 preferably protrude through actuating slots 25 and extend beyond the respective lateral wall 21, 22 into the outer environment of contact insert 1.

As can be seen, contact frame 2 is shaped like a wedge in a plan view of its respective lateral wall 21, 22. Securing tab 41 is located at the narrow end of the wedge shape. Spring bend 43 is located at the wide end of the wedge shape. Due to the wedge-shaped design of contact frame 2, a stripped end of a flexible electrical conductor can advantageously be better bundled in the receptacle formed by the wedge-shaped contour. A further positive secondary effect is the saving of space and materials.

Contact frame 2 also has additional recesses 29 in lateral walls 21, 22 in the area of securing tab 41. In this way, securing tab 41 protrudes out of the space enclosed by contact frame 2 and can in this way be hooked into the cutout of a busbar.

An end stop 31 for an electrical conductor to be inserted is formed further on contact frame 2, e.g., in the form of a tab which is bent towards the interior of contact frame 2 and which is punched out of contact base 2 and bent.

Figure 3:
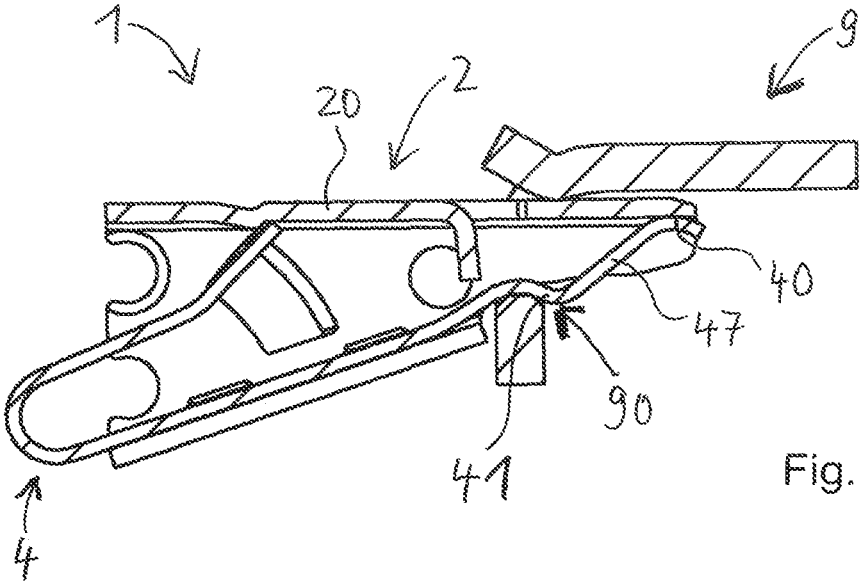
FIG. 3 shows an assembly with the contact insert according to FIGS. 1-2 and an external busbar in a lateral sectional illustration.

FIG. 3 shows an assembly with a contact insert 1 of the type described above and a busbar 9, which can be, e.g., a busbar or a busbar section of a conductor connection terminal. Busbar 9 has a cutout 90. As can be seen, contact insert 1 is hooked in cutout 90 with the side on which securing tab 41 projects. In this way, contact frame 1 is fixed in cutout 90 by the spring force of clamping spring 4. Securing tab 41 engages behind a region of the inner wall of cutout 90. On the opposite side, contact base 20 rests against another area of the inner wall of cutout 90.

When arc-shaped area 40 at the end, as mentioned above, rests against contact base 20, the clamping force of clamping spring 4 in the area of contact arm 42 is increased hereby, so that the fixation of contact insert 1 in cutout 90 is improved. Alternatively, a contact pin or contact blade or a flat busbar section can be inserted between contact base 20 and arc-shaped area 40 of clamping spring 4 and secured in a clamping manner.

Contact insert 1 can be inserted into cutout 90 in a simple manner in that contact insert 1 is simply inserted into cutout 90 in the orientation shown. In this regard, first, ramp-shaped area 47 slides along part of the inner wall of cutout 90, wherein contact arm 42 is thereby displaced and, when the end position shown in FIG. 3 is reached, securing tab 41 can engage behind part of the wall of cutout 90. To release contact insert 1 from cutout 90, it is only necessary to pull on it. Here, contact arm 42 is again displaced and securing tab 41 is pulled over the edge of cutout 90.

Figure 4:
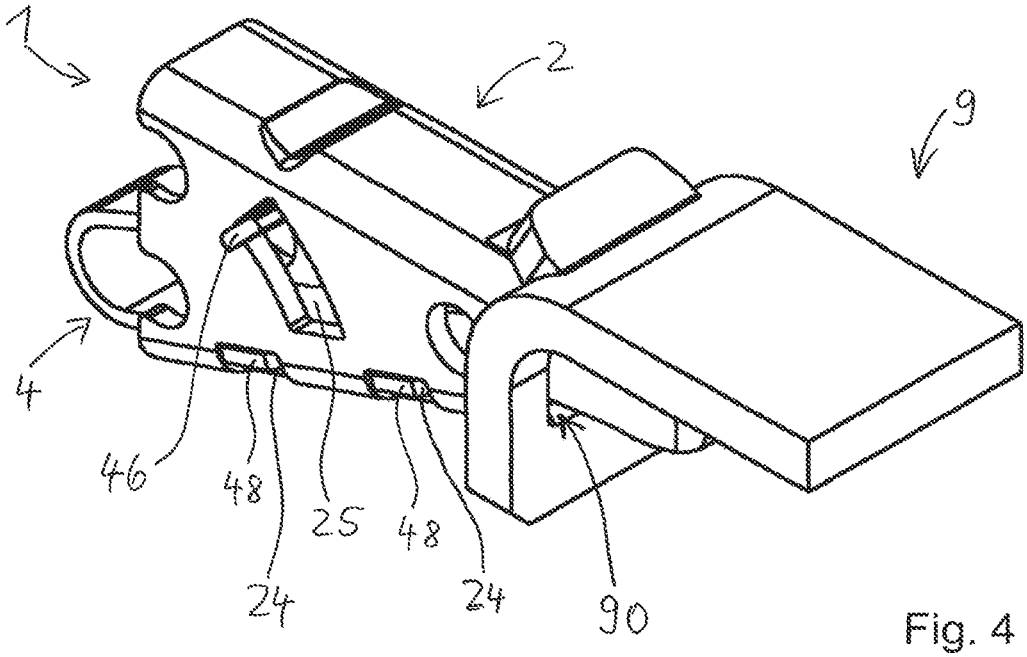
FIG. 4 shows the assembly according to FIG. 3 in a perspective illustration.

FIG. 4 also shows the assembly according to FIG. 3 in a perspective illustration. In particular, the form-fitting securing between fixing projections 48 and fixing slots 24 can be seen here. It can be clearly seen further that actuating tab 46 protrudes through actuating slot 25 and protrudes slightly out of contact frame 2.

Figure 5:
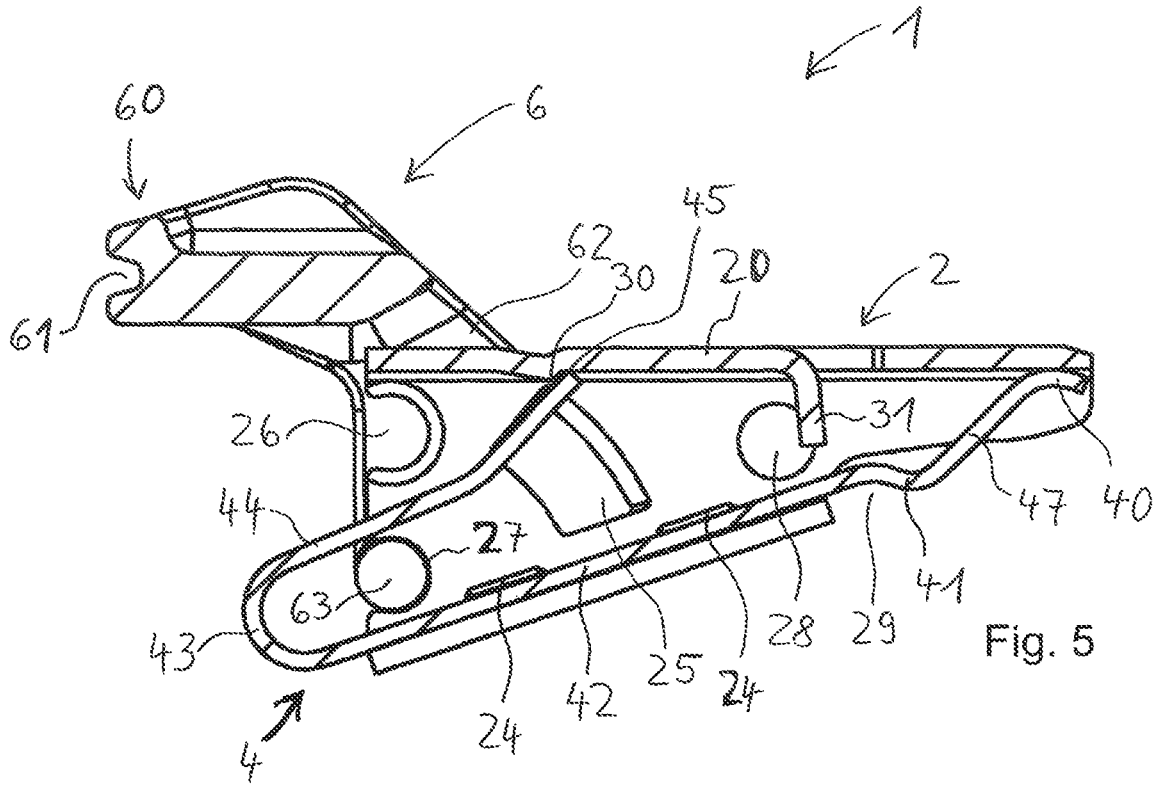
FIGS. 5-8 show a contact insert with an actuation element in an example.
Figure 6:
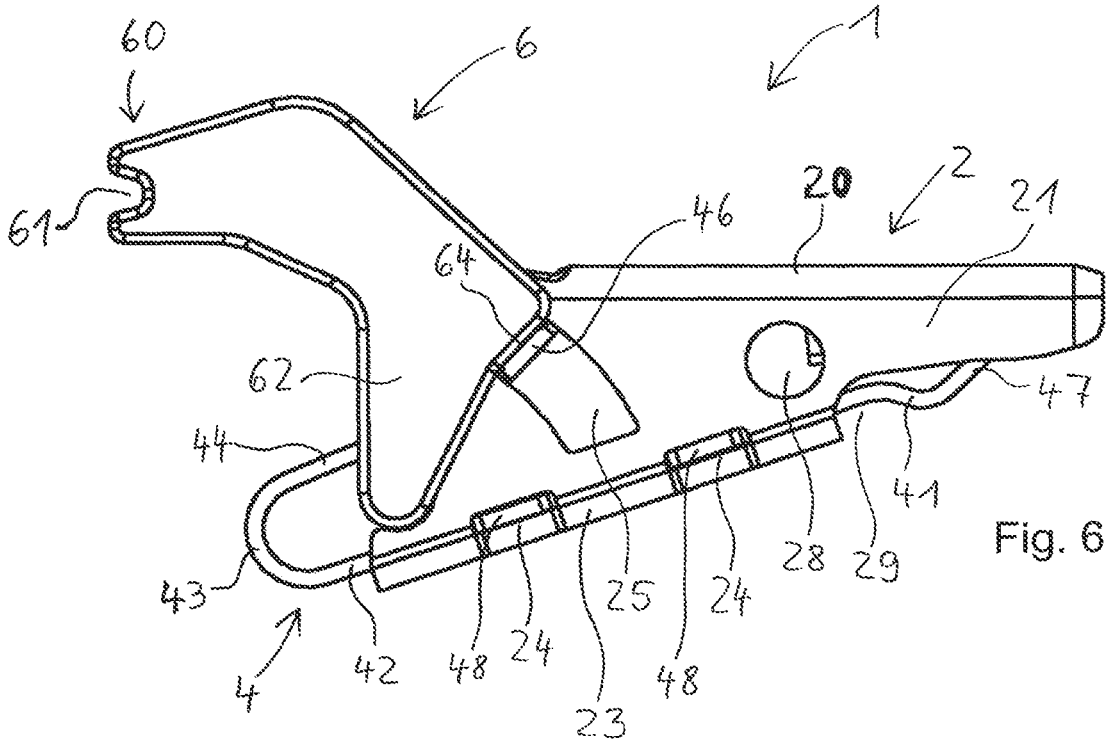

FIGS. 5 and 6 show contact insert 1 according to FIGS. 1 and 2, wherein contact insert 1 now has an actuation element 6 as an additional component. In this case, actuation element 6 is designed as a pivotable handle. Actuation element 6 has a manual actuation area 60 in which the actuation element 6 can be manually actuated by the user. In the illustrated exemplary embodiment, actuation element 6 has a groove-shaped recess 61 in actuating area 60, via which actuation element 6 can be actuated, for example, with a screwdriver.

Actuation element 6 extends over side cheeks 62 to a bearing pin 63 which is inserted in bearing element 27 of contact frame 2 and is mounted there. In all exemplary embodiments, a bearing pin 63 protruding towards contact frame 2 can be located, e.g., on each side cheek 62. Bearing pin 63 thus forms an axis of rotation of actuation element 6. Actuation element 6 in addition has a contact surface 64 on each of side cheeks 62 with which actuation element 6 surrounds contact frame 2. By means of contact surface 64, actuating tab 46 is acted upon mechanically and in this way clamping arm 44 is displaced. Bearing elements 26, 28 are not used in this exemplary embodiment.

FIGS. 5 and 6 show contact insert 1 in the unactuated state; i.e., actuation element 6 is not manually actuated in this case.

Figure 7:
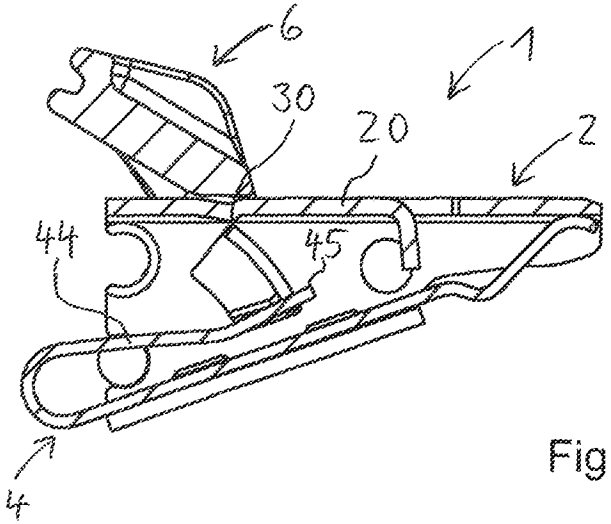
Figure 8:
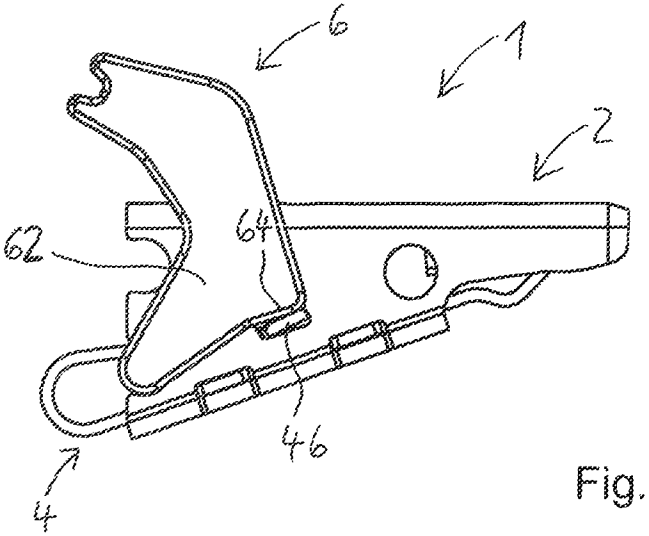

FIGS. 7 and 8 show contact insert 1 according to FIGS. 5 and 6 in the actuated state. Actuation element 6 is now pivoted by manually acting on actuation area 60. Actuating tab 46 is now displaced by contact surface 64, so that clamping arm 44 and in particular clamping edge 45 are moved away from contact base 20. The clamping point is now open. If the manual actuation of actuation element 6 is ended, it moves back into the original, unactuated position, shown in FIGS. 5 and 6, by the restoring force of clamping spring 4.

Figure 9:
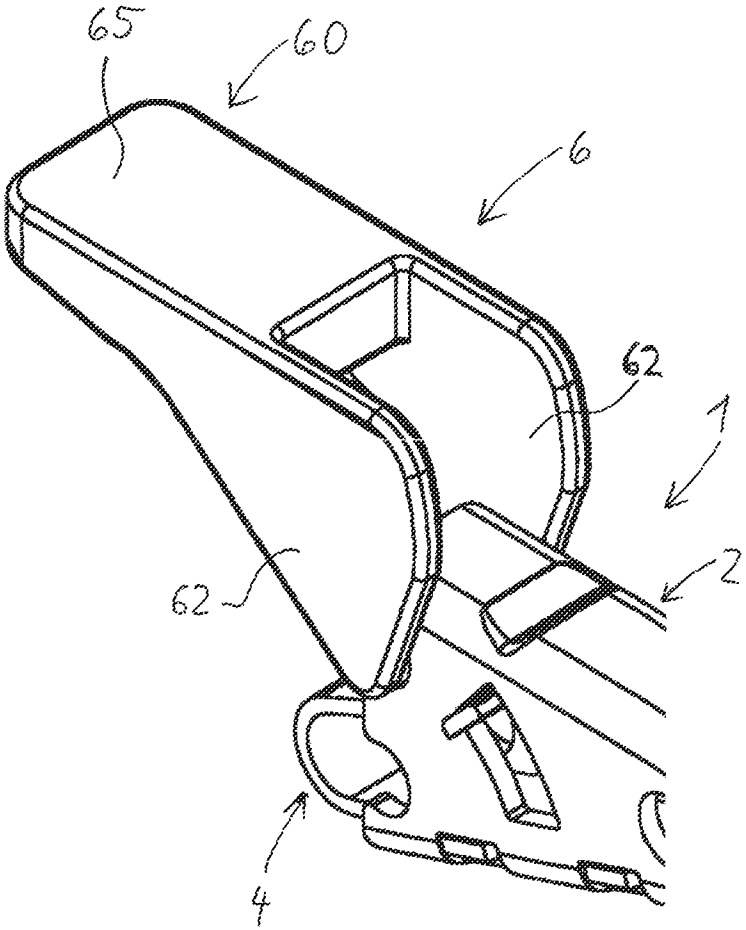
FIGS. 9-13 show a contact insert with an actuation element in a second embodiment.

FIG. 9 shows part of contact insert 1 with an actuation element 6 in a further embodiment. Actuation element 6 according to FIG. 9 is designed as an actuation lever. It can be seen in particular that actuation element 6 in turn has two side cheeks 62 with which actuation element 6 surrounds contact frame 2 from the outside. In manual actuation area 60, actuation element 6 has an actuation handle 65 which is designed for direct manual actuation by a user.

Figure 11:
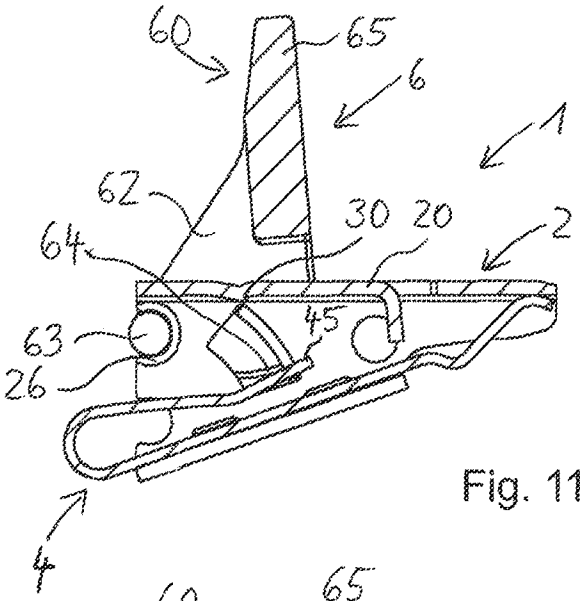
Figure 13:
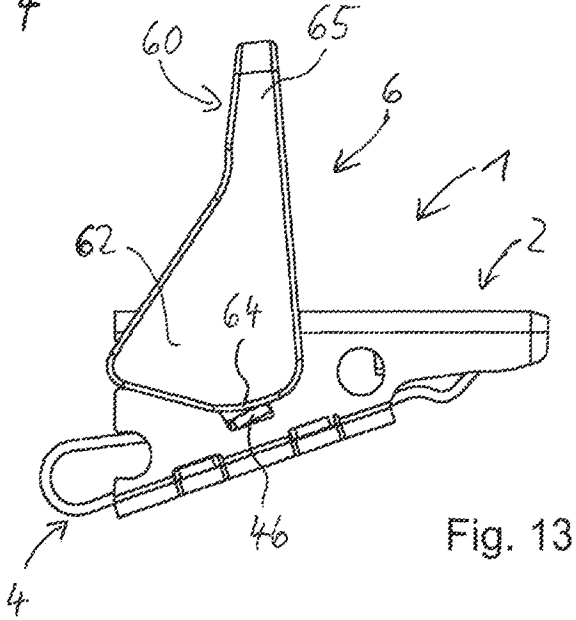
Figure 10:
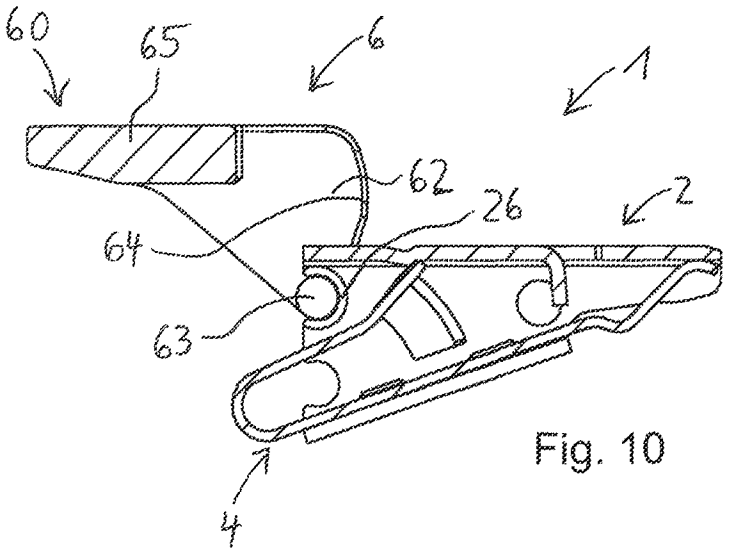
Figure 12:
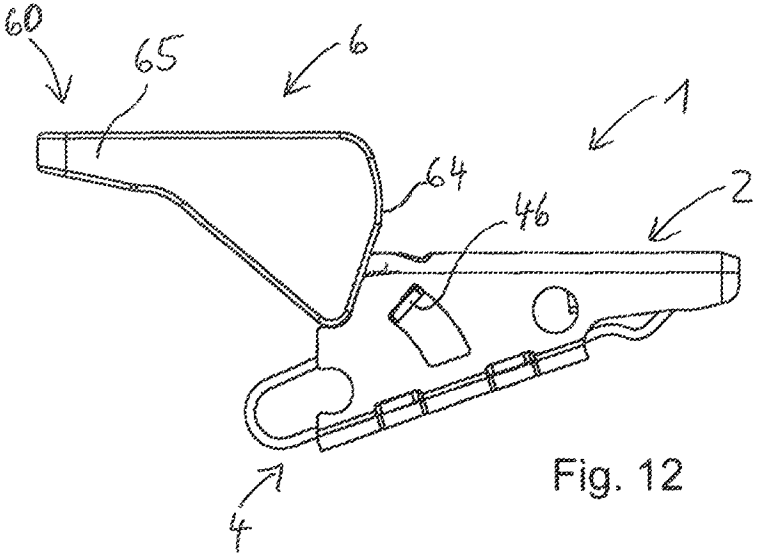

Contact insert 1 with actuation element 6 according to FIG. 9 is also shown in FIGS. 10 and 12 in the unactuated state and in FIGS. 11 and 13 in the actuated state. As can be seen, actuation element 6 again has a bearing pin 63. In this exemplary embodiment, bearing pin 63 is disposed in bearing element 26 and mounted therein. Bearing elements 27, 28 are not used in this exemplary embodiment.

Actuation element 6 in turn has a contact surface 64 for mechanically acting on actuating tab 46. As FIGS. 11 and 13 show, clamping arm 44 with clamping edge 45 is again moved away from contact base 20 in the actuated state.

FIGS. 14 to 17 show a further embodiment of contact insert 1 with an actuation element 6, which in this case is a combination of a pushbutton and an actuation lever. In this exemplary embodiment, actuation element 6 is inserted via its bearing pin 63 in bearing element 28 and is mounted therein. Bearing elements 26, 27 are not used in this exemplary embodiment.

In this exemplary embodiment, actuation element 6 has both an actuation handle 65 and a groove-shaped recess 61 in manual actuation area 60. A user can manually actuate actuation element 60 directly on actuation handle 65, even without a tool. Groove-shaped recess 61 can be used for actuation with a tool, e.g., by a screwdriver.

Actuation element 6 again has two side cheeks 62 with which contact frame 2 is surrounded from the outside. Further, actuation element 6 again has contact surface 64, which is used to act upon actuating tab 46 mechanically.

Figure 14:
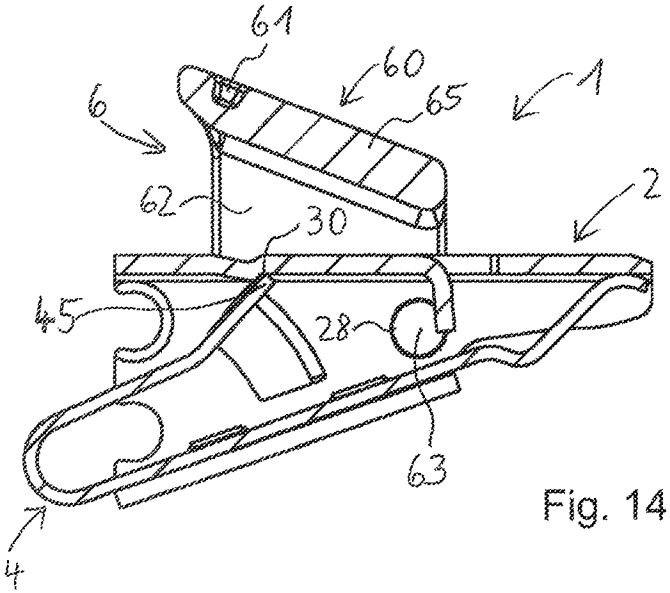
FIGS. 14-17 show a contact insert with an actuation element in a third embodiment.
Figure 15:
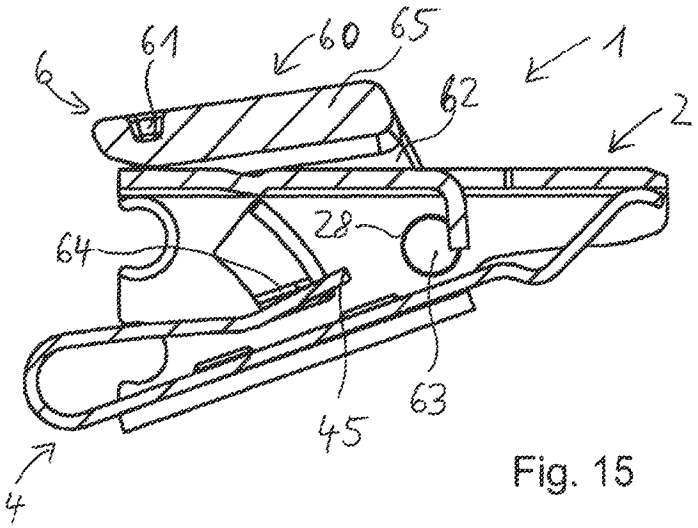
Figure 16:
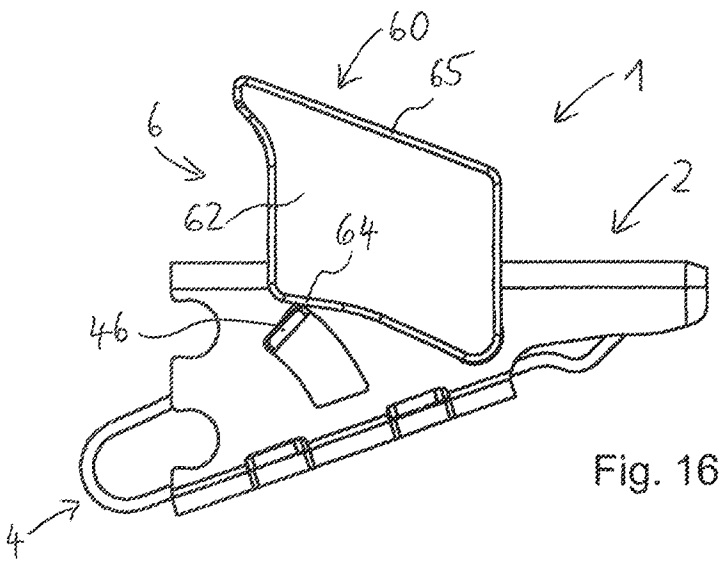
Figure 17:
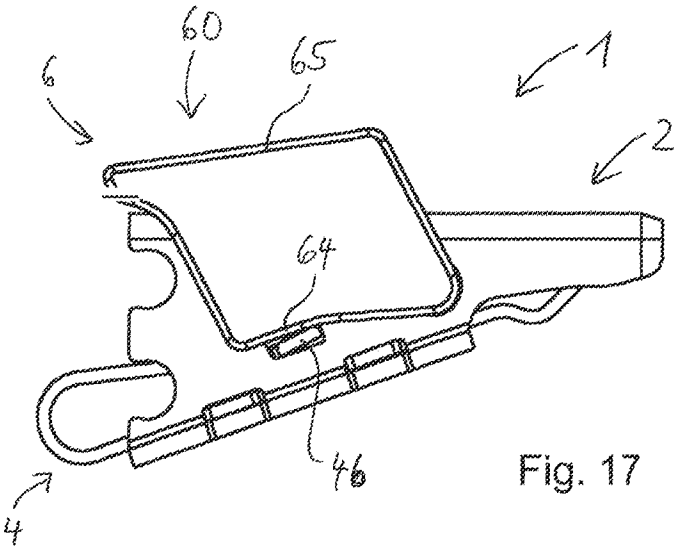

FIGS. 14 and 16 show contact insert 1 in the unactuated case. In FIGS. 15 and 17, the contact insert is shown in the actuated case. As can be seen, in this case clamping arm 44 is moved with clamping edge 45 away from contact base 20.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact insert for clamping an electric conductor to a clamping point via a clamping spring, the contact insert comprising:

the clamping spring, wherein the clamping spring has a contact arm, a spring bend that adjoins the contact arm, and a clamping arm that adjoins the spring bend; and a contact frame that has at least one contact base and two lateral walls arranged at an angle to the contact base, the two lateral walls running substantially parallel to each other with a receiving area formed therebetween, wherein the clamping spring is arranged in the receiving area, wherein the contact arm is secured to one or both of the two lateral walls or to at least one securing wall that adjoins one or both of the two lateral walls, wherein the clamping arm is pretensioned relative to the contact base, wherein the clamping point for the electric conductor to be clamped is formed between the clamping arm and the contact base, and wherein the contact frame has a plurality of bearing elements for mounting an actuation element which is designed to actuate the clamping arm, the actuation element being adapted to be mounted on one of the multiple bearing elements and secured to the contact frame.

2. The contact insert according to claim 1, wherein the contact frame is formed wedge-shaped in a plan view of a respective one of the two lateral walls.

3. The contact insert according to claim 1, wherein one, a plurality, or all of the bearing elements are arranged on one or on both of the two lateral walls of the contact frame.

4. The contact insert according to claim 1, wherein the contact insert comprises the actuation element.

5. The contact insert according to claim 4, wherein the actuation element overlaps the contact frame on both sides.

6. The contact insert according to claim 1, wherein the contact arm has laterally protruding fixing projections that positively engage in fixing slots present in one or in both of the two lateral walls.

7. A method for providing the contact insert according to claim 6, the method comprising:

producing the clamping spring with the fixing projections protruding laterally on the contact arm;

providing a semi-finished product of the contact frame by punching out a piece of sheet metal from a sheet metal plate; and generating the final shape of the contact frame by a bending process in which the clamping spring is inserted into the contact frame at least before the end of the bending process and is fixed in the fixing slots in the one or both of the two lateral walls by positive fixation via the fixation projections.

8. The contact insert according to claim 1, wherein the clamping arm has at least one laterally protruding actuating tab that projects into an actuating slot in at least one of the two lateral walls or protrudes through the actuating slot, wherein the actuating tab has at least one contact surface which is acted upon by the actuation element so that the clamping arm is adapted to be displaced when the actuating tab is actuated via the actuation element.

9. The contact insert according to claim 1, wherein the contact frame is designed as a receiving cage, which is essentially closed on a periphery, for receiving the clamping spring.

10. A conductor connection terminal with the contact insert according to claim 1, wherein the conductor connection terminal has an insulating-material housing which completely or predominantly surrounds the contact insert.

11. A contact insert for clamping an electric conductor to a clamping point via a clamping spring, the contact insert comprising:

the clamping spring, wherein the contact spring has a contact arm, a spring bend that adjoins the contact arm, and a clamping arm that adjoins the spring bend; and a contact frame that has at least one contact base and two lateral walls arranged at an angle to the contact base, the two lateral walls running substantially parallel to each other with a receiving area formed therebetween, wherein the clamping spring is arranged in the receiving area, wherein the contact arm is secured to one or both of the two lateral walls or to at least one securing wall that adjoins one or both of the two lateral walls, wherein the clamping arm is pretensioned relative to the contact base, and wherein the clamping point for the electric conductor to be clamped is formed between the clamping arm and the contact base, and wherein the contact arm has a securing tab that protrudes from the contact frame, wherein the contact insert is adapted to be releasably fixed to a busbar by the securing tab via a spring force fixing.

12. An assembly comprising the contact insert according to claim 11 and a busbar that has a cutout, wherein the contact insert is resiliently fixed in the cutout of the busbar via the securing tab.

* * * * *